United States Patent [19]

Sakazume et al.

[11] 4,108,668

[45] Aug. 22, 1978

[54] LIGHT-SENSITIVE SILVER HALIDE PHOTOGRAPHIC MATERIALS

[75] Inventors: Kaiichiro Sakazume; Noboru Fujimori; Eiichi Sakamoto, all of Hino; Hidehiko Ishikawa, Odawara, all of Japan

[73] Assignee: Konishiroku Photo Industry Co., Ltd., Tokyo, Japan

[21] Appl. No.: 792,125

[22] Filed: Apr. 29, 1977

Related U.S. Application Data

[63] Continuation of Ser. No. 504,952, Sep. 11, 1974, abandoned.

[30] Foreign Application Priority Data

Sep. 13, 1973 [JP] Japan ..... 48-102610

[51] Int. Cl.$^2$ ..... G03C 1/18

[52] U.S. Cl. ..... 96/135

[58] Field of Search ..... 96/135

[56] References Cited

U.S. PATENT DOCUMENTS 2,776,280 1/1957 Brooker et al. ..... 96/135

*Primary Examiner*—J. Travis Brown

*Attorney, Agent, or Firm*—Flynn & Frishauf

[57] ABSTRACT

Novel light-sensitive silver halide photographic materials comprising at least one sensitizing dye having the following formula:

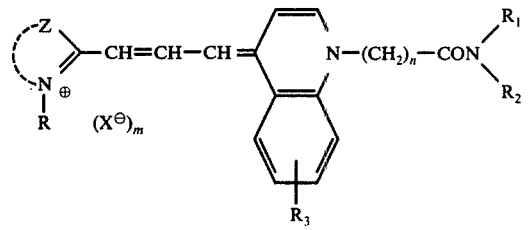

wherein Z represents a non-metallic atom group necessary for completing a three membered heterocyclic ring, R represents an alkyl or a substituted alkyl radical, $R_1$ and $R_2$ represent hydrogen atoms or lower alkyl radicals, $R_3$ represents a hydrogen atom, an alkyl or alkoxyl radical, *m* represents an integer of 0 or 1, X represents an acid anion and forms an inner salt when *m* is 0, and *n* represents an integer of 1 or 2.

10 Claims, No Drawings

LIGHT-SENSITIVE SILVER HALIDE PHOTOGRAPHIC MATERIALS

This is a continuation, of application Ser. No. 504,952, filed Sept. 11, 1974, now abandoned.

This invention relates to a light-sensitive silver halide photographic material spectrally sensitized. More particularly, this invention relates to a light-sensitive silver halide photographic material having the spectrally sensitized maximum at over 650 nm and high red sensitivity.

In the case of the preparation of light-sensitive photographic materials, it is known that incorporation of some kinds of sensitizing dyes into silver halide emulsion causes the domain of sensitizing wave length to increase further longer and thus the silver halide emulsion is sensitized. For example, as to sensitizing dyes for red sensitive emulsion of colour photographic materials, there are known carbocyanine dyes containing 4-quinoline nucleus. Especially, carbocyanine dyes comprising a 4-quinoline and naphthazole nucleus are considered to be valuable because of strong sensitizing activity toward the red to the red end. But while these sensitizing dyes exhibit excellent spectral distribution, they have such defects in that these dyes are apt to produce fog and decrease their light sensitivity greatly due to the lapse of time. To improve such defects of these sensitized dyes, anti-foggants and stabilizers such as, for example, tetrazaindene, and mercaptoazole are usually incorporated into light-sensitive silver halide photo materials, but they are hardly effective for decreasing fog of dyes and cause the spectral sensitivity to decrease even it has some effect on decreasing fog, and they remarkably deteriorate the photographic materials owing to the lapse of time. Therefore, it is one of the most important problems to select an anti-foggant or stabilizer not having harmful effects, depending upon the kinds of sensitizing dyes used. On the other hand, it is still more important for spectral sensitization arts to find a sensitizing dye without such properties resulting in fog and time-deterioration of its sensitizing activity.

An object of this invention is to provide novel sensitizing dyes which strongly sensitize silver halide photographic materials in the domain of 650–750 nm and cause little fog and time-deterioration of spectral sensitivity. Another object of this invention is to provide novel light-sensitive silver halide photographic materials having sensitized silver halide emulsion layers by using the said sensitizing dyes.

We have found that the above objects can be achieved by using the following carbocyanine dyes having the formula:

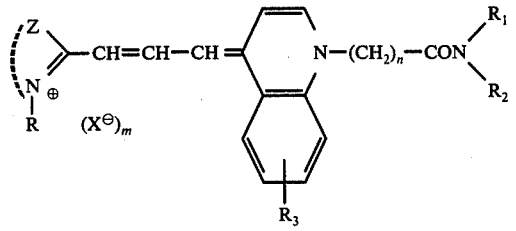

wherein Z represents a non-metallic atom group necessary for completing a naphthothiazole e.g., naphtho[2,1-d]thiazole, naphtho[2,3-d]thiazole, and naphtho[1,2-d]thiazole, naphthoselenazole, e.g., naphtho[2,1-d]selenazole, naphtho[2,3-d]thiazole, and naphtho[1,2-d]selenazole, naphthoimidazole, e.g., naphtho[2,1-d]imidazole and naphtho[1,2-d]imidazole, naphthoxazole, e.g., naphtho[2,1-d]xazole, naphtho[2,3-d]xazole, and naphtho[1,2-d]xazole, or benzindolenine nucleus, e.g., benz[f]indolenine, benz[e]indolenine and benz[g]indolenine, R represents an alkyl or a substituted alkyl radical, preferably a lower alkyl or substituted alkyl radical having carbon atoms 1–4, e.g., methyl, ethyl, n-propyl, isopropyl, n-butyl or isobutyl, $R_1$ and $R_2$ represent hydrogen atoms or lower alkyl radicals, preferably lower alkyl radicals having carbon atoms 1–4, e.g., methyl, ethyl, n-propyl, isopropyl, n-butyl or isobutyl, $R_3$ represents a hydrogen atom, an alkyl, preferably a lower alkyl having carbon atoms 1–4, e.g., methyl, ethyl, n-propyl, isopropyl, n-butyl, or isobutyl, or alkoxy radical, preferably lower alkoxyl radical having carbon atoms 1–4, e.g.: methoxyl, ethoxyl, n-propoxyl, isopropoxyl, n-butoxyl or isobutoxyl, *m* represents an integer of 0 or 1, X represents an acid anion and foams an inner salt when *m* is 0, and *n* represents an integer of 1 or 2. The said heterocyclic nuclei may be substituted with a lower alkyl radical having carbon atoms 1–4, e.g., methyl, ethyl, n-propyl, isopropyl, n-butyl or isobutyl, or a lower alkoxy radical having carbon atoms 1–4, e.g., methoxyl, ethoxyl, n-propoxyl, isopropoxyl, n-butoxyl or isobutoxyl.

The characteristics of the sensitizing dyes having the above formula according to this invention are found in the fact that, among two heterocyclic nuclei constituting carbocyanines, one is a 4-quinoline nucleus and the other is a naphthazole nucleus and the 4-quinoline nucleus has a carbamoylalkyl radical at the nitrogen atom.

As is stated above, the known 4-carbocyanine dyes which have their spectrally sensitized maximum at 650 nm, when incorporated into red sensitive emulsion layer, cannot be used alone without adding other additives because these carbocyanine dyes have better spectral distribution but are apt to cause fog or have an excessive time-deterioration of spectral sensitivity. On the other hand, 4'-quinoline carbocyanine dyes having a carbamoyl substituent on the nitrogen atom of the 4-quinoline nucleus have not such defects and are characterized by the fact that these dyes have no such defects but a remarkable resistance to the dye elimination due to the coloured coupiers, so that these dyes have no desensitizing activity in the colour emulsion.

The cyanine dyes having a carbamoyl substituent on the nitrogen atom of the heterocyclic nucleus containing a nitrogen atom are disclosed in U.S. Pat. No. 2,776,280 and B. Pat. No. 1,001,480, but 4'-carbocyanine dyes having the above formula according to this invention have the above excellent advantages as compared with these known cyanine dyes.

The 4'-carbocyanine dyes having the above formula according to this invention can be prepared by a conventional procedure used for the preparation of 4'-carbocyanine dyes. That is, they can be obtained by heating the following intermediates (I) and (II) or (III) and (IV) in a suitable solvent such as methanol, ethanol or acetic anhydride in the presence of a basic binding agent such as triethanolamine or diethylaminoethanol:

Intermediates (I)

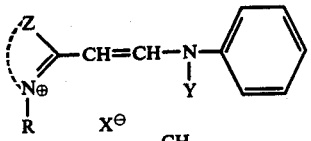

(II)

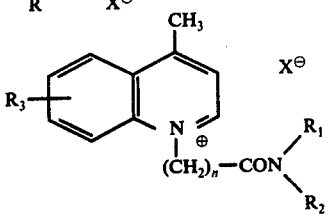

(III)

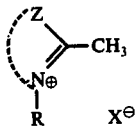

-continued (IV)

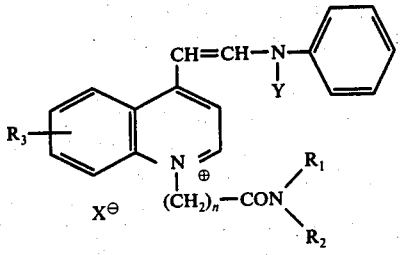

wherein Z, X, R, $R_1$, $R_2$, $R_3$ and $n$ have the same meanings as in the above general formula and Y represents a hydrogen, an alkyl or acyl radical.

The representative sensitizing dyes having the general formula according to this invention are exemplified as follows but these are not limitative:

Examplified compounds

| | m.p. (° C) | Absorption Maximum (in methanol) (nm) |
|---|---|---|
| (1) 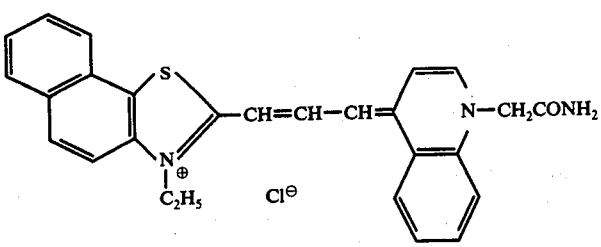 | 283–285 | 654 |
| (2) 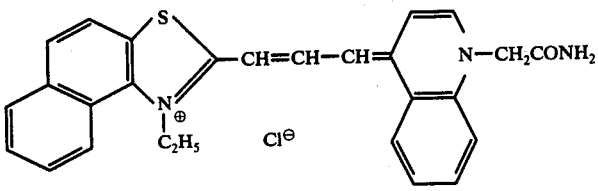 | 209–210 | 659 |
| (3) 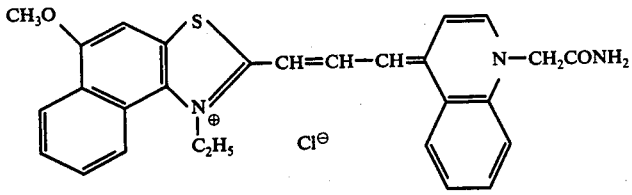 | 225 | 670 |
| (4) 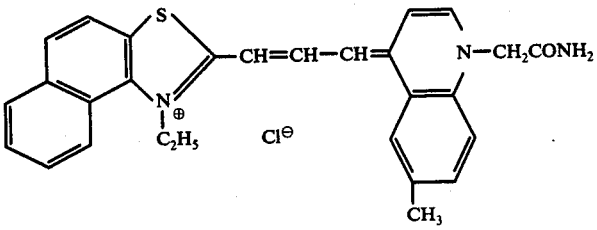 | 215–220 | 658 |
| (5) 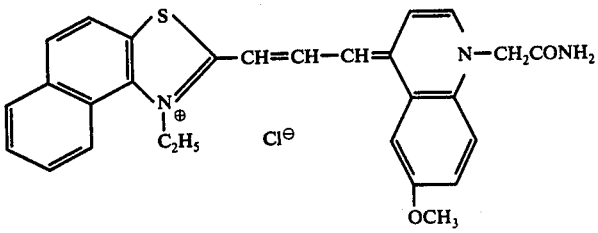 | 208–210 | 660 |

-continued

Examplified compounds

| | | m.p. (° C) | Absorption Maximum (in methanol) (nm) |
|---|---|---|---|
| (6) | 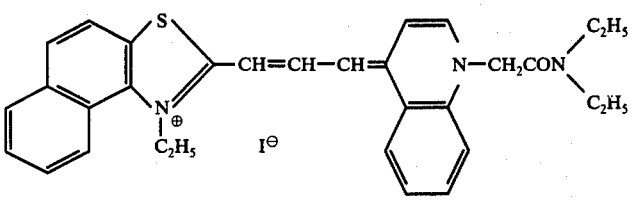 | 218–220 | 660 |
| (7) | 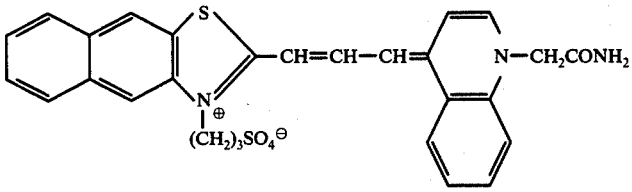 | 310 | 636 |
| (8) | 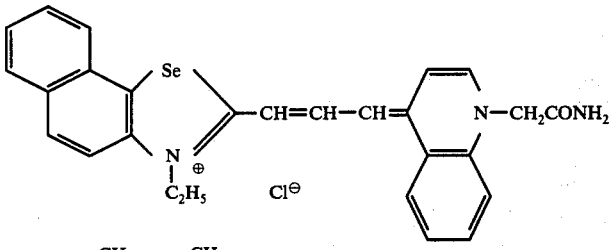 | 250 | 659 |
| (9) | 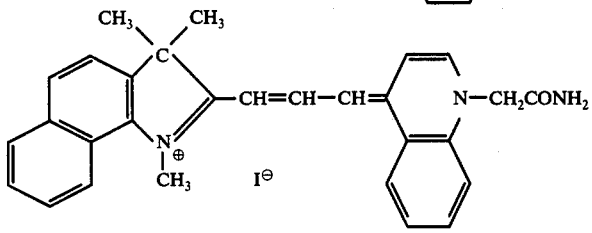 | 290 | 632 |
| (10) | 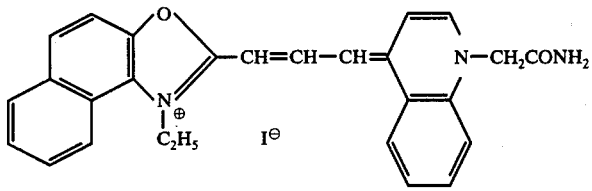 | 288–290 | 618 |

Next, the synthetic methods of the intermediates for the preparation of these sensitizing dyes and of the sensitizing dyes using these intermediates will be illustrated by the following examples, but these are not limitative.

SYNTHESIS EXAMPLE 1

Synthesis of 1-carbamoylmethyllepindinium chloride (Intermediate)

In 50 ml of dioxane 28.6 g of lepidine (0.2 mole) and 21.5 g of chloroacetamide (0.23 mole) were refluxed in an oil bath of 140° C for 10 hours and the precipitated crystals were collected, washed with acetone and dried. 36 g of this crude product was recrystallized from 300 ml of methanol to give a yield of 31.5 g (83%): M.p., 266°–267° C.

SYNTHESIS EXAMPLE 2

1-Carbamoylmethyl-6-methoxylepidinium chloride (Intermediate)

In 30 ml of dioxane 17.3 g of 6-methoxylepidine (0.1 mole) and 11.3 g of chloroacetamide (0.12 mole) were refluxed for 8 hours and the precipitated crystals were collected, washed with acetone and dried. Yield, 24.18 g (8.78%); M.p., 240°–241° C.

SYNTHESIS EXAMPLE 3

1-Carbamoylmethyl-6-methyllepidinium chloride (Intermediate)

Followed by the same procedure as in Synthesis Example 1 except that 6-methyllepidine was used instead of lepidine, the object compound was obtained. M.p., 278°–280° C.

SYNTHESIS EXAMPLE 4

Synthesis of 4-(β-anilinovinyl)-1-carbamoylmethyllepidinium chloride (Intermediate)

In 40 ml of methanol 4.74 g of 1-carbamoylmethyllepidinium chloride (0.02 mole) and 4.4 g of diphenylformamidine (0.022 mole) were refluxed for 1 hour and the precipitated crystals were collected, washed with acetone and dried. 6.2 g of this crude product was recrystallized from 450 ml of methanol. Yield, 4.7 g (69%); M.p., 272°–275° C.

SYNTHESIS EXAMPLE 5

Synthesis of the exemplified compound (1)

In 50 ml of methanol 2.37 g of 1-carbamoylmethyllepidinium chloride (0.01 mole), 5.45 g of 2-(β-acetanilidovinyl)-3-ethyl-naphtho[2,1-d]thiazolium-p-toluenesulfonate (0.01 mole) and 1.5 g of triethylamine (0.015 mole) were refluxed for 15 minutes. The precipitated crystals were collected, washed with acetone-ether and dried. 2.8 g of this crude product was recrystallized twice from methanol. Yield, 2.0 g (41%); M.p., 283°–285° C.

SYNTHESIS EXAMPLE 6

Synthesis of the exemplified compound (2)

In 100 ml of acetic anhydride 3.4 g of 4-(β-anilinovinyl)-1-carbamoylmethyllepidinium chloride (0.01 mole), 4 g of 2-methyl-1-ethylnaphtho[1,2-d]thiazolium-p-toluene-sulfonate (0.01 mole) and 3 g of triethylamine (0.03 mole) were heated with stirring on a water bath for 30 minutes. After completion of the reaction, 100 ml of acetone was added to the reaction mixture and the precipitated crystals were collected, washed with acetone-ether and dried. 3.4 g of this crude product thus obtained was recrystallized from methanol. Yield, 2.6 g (53%); M.p., 209°–210° C.

SYNTHESIS EXAMPLE 7

Synthesis of the exemplified compound (5)

In 120 ml of acetic anhydride 5.0 g of 2-(β-anilinovinyl)-1-ethylnaphtho[1,2-d]thiazoline-p-toluene-sulfonate (0.01 mole), 2.8 g of 1-carbamoylmethyl-6-methoxylepidinium chloride (0.01 mole) and 3 g triethylamine (0.03 mole) were heated with stirring on a water bath for 20 minutes. After completion of the reaction, 120 ml of acetone was added to the reaction mixture and the precipitated crystals were collected, washed with acetone-ether and dried. 3.2 g of the crude product thus obtained was recrystallized from methanol. Yield, 2.4 g (49%); M.p., 208°–210° C.

SYNTHESIS EXAMPLE 8

Synthesis of the exemplified compound (8)

In 120 ml of acetic anhydride 3.4 g of 4-(β-anilinovinyl)-1-carbamoylmethyllepidinium chloride (0.01 mole), 4.4 g of 2-methyl-3-ethylnaphtho[2,1-d]selenazolium-p-toluenesulfonate and 3 g of triethylamine (0.03 mole) were heated with stirring on a water bath for 20 minutes. After completion of the reaction, the crystals were collected, washed with ether-acetone and dried. 3 g of this crude product thus obtained was recrystallized from methanol. Yield, 1.9 g (36%); M.p., 250° C.

SYNTHESIS EXAMPLE 9

Synthesis of the exemplified compound (10)

In 120 ml of acetic anhydride, 2.4 g of 1-carbamoylmethyllepidinium chloride (0.01 mole), 4.4 g of 2-(β-anilinovinyl-1-ethylnaphtho[1,2-d]oxazolium iodide (0.01 mole) were heated with stirring on a water bath for 10 minutes. After completion of the reaction, the crystals were collected, washed with acetone and dried. 2.2 g of the crude product thus obtained was recrystallized from methanol. Yield, 1.7 g (31%); M.p., 288°–290° C.

The sensitizing dyes according to this invention can be incorporated into red-sensitive emulsion of black and white sensitive materials as well as colour sensitive materials and are effective for sensitizing in the red to the red end. These sensitizing dyes can be preferably incorporated into silver halide emulsions and this incorporation can be generally effected by dissolving these dyes in an organic solvent such as ethanol or methanol. The time of the incorporation can be optionally selected during the course of manufacture of sensitive materials, but the dyes can be preferably incorporated into silver halide emulsions after completion of the second ripening, especially soon after completion of the second ripening. The amount incorporated of the dyes varies with the use objects, and the kinds of silver halide emulsions, but is usually in a range of about 1–500 mg per one kg of the silver halide emulsion.

The silver halide contained in silver halide emulsions used for the light-sensitive silver halide photographic materials according to this invention may be a silver halide such as silver iodobromide, silver chlorobromide, silver bromide, silver chloroiodobromide or silver chloride and such silver halides may be those prepared by means of an ammonia method, a neutral method, a simultaneous mixing method, or a conversion method. These silver halides can be generally dispersed into gelatine, but polymers such as polyvinylalcohol can be used in place of gelatine or in a mixture with gelatine. The silver halide emulsions into which these silver halides are dispersed in a suitable binder can be chemically sensitized by single or combination use of chemical sensitizers such as active gelatine; noble metal sensitizers, for example, water soluble gold salt, water soluble platinum salt, water soluble palladium salt, water soluble rhodium or water soluble iridium salt; sulfur sensitizer, selen sensitizer; and reduction sensitizers, for example, polyamine, or stannous chloride. Also, as to other sensitizers, the sensitizers of polyalkylene oxide derivatives may be contained and, if necessary, several spectral sensitizers may be contained.

Further, to these silver halide emulsions can be added the following several other photographic additives: hardening agents such as aldehyde derivatives, e.g., formaldehyde, halogenoaliphatic acid, e.g., mucobromic acid, vinylsulfonyl type compound, acryloyl type compound and ethyleneimine type compound; coating aids or surface active agents such as saponin, lauryl or oleylmonoether of polyethyleneglycol; stabilizers such as triazole and azaindene derivatives; physical property improving agents such as dispersed polymer in water (latex); anti-foggants such as ammonium chloroplatinite, and mercaptan; couplers such as 5-pyrazolone type magenta couplers, acylacetamide type yellow couplers, and phenol or naphthol type cyan couplers (these couplers may be colour couplers, colourless couplers, so-called computing couplers, or so-called development inhibitor releasing couplers (DIR couplers) and can be used singly or in combinations, depending upon the object used); dispersing agents used as coupler solvents such as tricresyl phosphate, dibutyl phthalate, ethyl acetate, butyl acetate, chloroform and methanol; other ultraviolet absorbents, fluorescent brightening agents (for example, fluorescent brightening agents disclosed in Patent Publication No. Sho 34-7127/1959) and several photographic additives such as condensation products of phenol and formalin. Also, these silver halide emulsions may be silver chloride, silver chlorobromide, or silver chloroiodobromide emulsion which contains no cadmium ion.

The light-sensitive silver halide photographic materials can be generally prepared by coating this silver halide emulsion on a suitable support and as to the supports to be used, there can be used supports such as paper, glass, cellulose acetate, cellulose nitrate, polyester, polyamide, polystyrene and polyolefin or combined supports of more than two bases such as a laminate of paper and polyolefin (polyethylene, polypropylene and etc.) These supports can generally undergo several surface improving procedures in order to improve their adhesive character to silver halide emulsions. And the supports treated with, for example, surface treatments such as corona discharge and electron impact treatment or under coating forming an under layer can be used.

As to coating and drying the silver halide emulsion to these supports, there can be applied a conventional coating method such as dip coating, roller coating, bead coating, curtain flow coating method and dried subsequently.

The light-sensitive silver halide photographic materials according to this invention can be principally composed as described above and as to the light-sensitive silver halide photographic materials used for their kinds and use objects such as negative, positive or direct positive black and white or colour photographic material; or diffusion transfer or silver dye bleaching type photographic material; or X-ray or printing photographic material for general or specific use, generally several constitutional elements of the light-sensitive silver halide photographic materials such as an intermediate layer, protecting layer, filter layer and image receiving layer can be contained and the photographic materials can be composed of more than two layers consisting of different silver halide emulsions such as colour light-sensitive photographic materials.

The thus composed light-sensitive silver halide photographic materials are provided with excellent colour sensitivity towards especially from the red to the red end, and durability so that highly light-sensitive photographic materials with stable photographic characteristics are obtained.

The present invention is illustrated in further detail with the following non-limitative examples.

EXAMPLE 1

A silver chlorobromide gelatine emulsion containing 80 mole % of silver chloride was divided in parts just before completion of its second ripening and the exemplified compounds (1), (2), (3), (4), (5), (6), (7), (8), (9) and (10) and the following control compounds (A), (B) and (C) were incorporated into the respective parts in a 0.1% methanolic solution so as to contain each compound in an amount of 20 mg per 1 kg of the emulsion. The thus prepared emulsions were coated on cellulose triacetate films respectively and dried to obtain red-sensitive photographic materials, that is, Samples (1)–(10) and Control Samples (1)–(3). Control Sample (4) was prepared by coating the emulsion containing no sensitizing dye on a cellulose triacetate film in the same manner as described above and drying.

Control compounds

-continued (A)

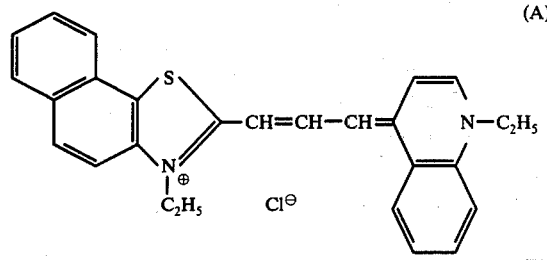

(B)

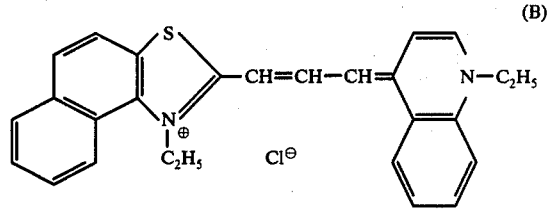

(C)

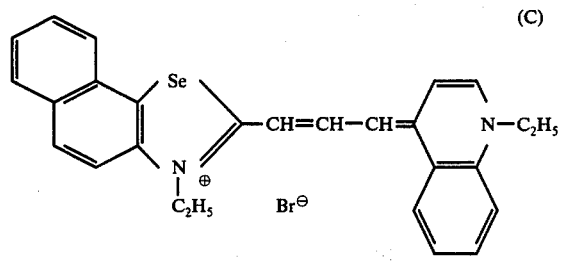

These 10 Samples and four Control Samples were exposed to the red of over 590 nm through a lattice filter (No. 25) by means of KS-7 type sensitometer (manufactured by Konishiroku Photo Ind., Co., Ltd.) and developed at 20° C for 5 minutes with a developer of the following composition:

| | |
|---|---|
| N-methyl-p-aminophenol sulfate | 3 g |
| Hydroquinone | 6 g |
| Anhydrous sodium sulfite | 50 g |
| Sodium carbonate (monohydrate) | 29.5 g |
| Potassium bromide | 1 g |
| Water to make | 2 l |

Subsequently, the developed photographic films were subjected to ordinary stopping, fixing, washing with water and drying treatments and then the sensitivity and fog of the films were measured. On the other hand, these Samples and Control Samples were exposed with a lattice spectral camera and treated in the same manner as described above and the respective spectral sensitivity was measured. The results are shown in Table I.

Table I

| Sample No. | | Added sensitizing dye | | Sensitivity | Fog | Sensitized Maximum (nm) | Sensitized End (nm) |
|---|---|---|---|---|---|---|---|
| Sample | 1 | Exemplified compound | (1) | 135 | 0.04 | 680 | 750 |
| | 2 | " | (2) | 170 | 0.05 | 695 | 730 |
| | 3 | " | (3) | 140 | 0.04 | 700 | 730 |
| | 4 | " | (4) | 180 | 0.05 | 700 | 730 |
| | 5 | " | (5) | 185 | 0.05 | 700 | 740 |
| | 6 | " | (6) | 150 | 0.05 | 700 | 750 |
| | 7 | " | (7) | 130 | 0.05 | 670 | 700 |
| | 8 | " | (8) | 100 | 0.05 | 685 | 730 |
| | 9 | " | (9) | 105 | 0.04 | 680 | 710 |
| | 10 | " | (10) | 95 | 0.04 | 650 | 640 |
| Control | 1 | Control compound | (A) | 100 | 0.10 | 680 | 750 |
| | 2 | " | (B) | 120 | 0.12 | 690 | 740 |

Table I-continued

| Sample No. | | Added sensitizing dye | | Sensitivity | Fog | Sensitized Maximum (nm) | Sensitized End (nm) |
|---|---|---|---|---|---|---|---|
| Sample | 3 | " | (C) | 95 | 0.10 | 685 | 735 |
| | 4 | No adding | | — | 0.04 | — | — |

In Table I, the sensitivity was expressed by a relative value as 100 of that of Control Sample (1).

As is clear from Table I, it is understood that the Samples according to this invention have their respective spectral sensitivity in a domain of 670–750 nm and produce no fog as compared with the Control Samples using known sensitizing dyes and have high-sensitivity.

EXAMPLE 2

A silver iodobromide gelatine emulsion containing 3 mole % of silver iodide was divided in parts just before its second ripening and the exemplified compounds (1), (2), (3) and (5) and the control compounds (A) and (B) were incorporated into the parts in a 0.1% methanolic solution so as to contain each compound in an amount of 20 mg per 1 kg of the emulsion. The thus prepared emulsions were coated on the cellulose triacetate films respectively and dried to obtain Samples (11)–(14) and Control Samples (5)–(6).

The thus prepared four Samples and two Control Samples were treated in the same sensitometric procedure as in Example 1 and their sensitivity and fog of the film were measured. On the other hand, the above Samples and Control Samples, after being allowed to stand at 50° C in a 80% relative humidity for 3 days just after the preparation, were also treated by the same sensitometric procedure as described above and their sensitivity and fog of the films were measured to determine the time-change of the photographic characteristics. The results are shown in Table II.

Table II

| Sample No. | | Added Sensitizing dye | | Just after the preparation: Sensitivity | Just after the preparation: Fog | After allowing to stand: Sensitivity | After allowing to stand: Fog |
|---|---|---|---|---|---|---|---|
| Sample | 11 | Exemplified compound | (1) | 130 | 0.04 | 125 | 0.05 |
| | 12 | " | (2) | 170 | 0.05 | 165 | 0.06 |
| | 13 | " | (3) | 140 | 0.06 | 140 | 0.06 |
| | 14 | " | (5) | 170 | 0.06 | 160 | 0.07 |
| Control Sample | 5 | Control compound | (A) | 100 | 0.10 | 80 | 0.12 |
| | 6 | " | (B) | 120 | 0.12 | 105 | 0.14 |

In Table II, the sensitivity was expressed by a relative sensitivity as 100 of that of Control Sample (5) being just after the preparation.

As is clear from Table II, it is understood that the Samples according to this invention produce only a little increase of fog and a little decrease of sensitivity.

EXAMPLE 3

A blue-sensitive colour emulsion was prepared by adjusting to contain an adequate amount of dispersion solution of α-pivalyl-α-[4-(4-benzyloxyphenylsulfonyl)-phenoxy]2-chloro-5-[γ-(2,4-di-t-amylphenoxy)-butylamido]acetanilide as a yellow coupler in a positive silver iodochloride emulsion prepared by a conventional method and coated on a paper coated with polyethylene. After coating an intermediate layer consisting of only gelatine on it, it was coated in multilayers with an ortho-sensitizing silver chlorobromide (containing a 30% mole silver chloride) emulsion containing an adequate amount of 1-(2,4-dimethyl-6-chlorophenyl)-3-[3-{α-(m-pentadecylphenoxy)butylamido}benzamido]-5-pyrazolone as a magenta coupler and further a gelatine intermediate layer was prepared on it so as to constitute multilayers. 4 Parts of such multilayer materials were prepared and four kinds of red-sensitive emulsion containing cyan couplers were prepared by adjusting to contain the exemplified compounds (1) and (2), and the control compounds (A) and (B) in an amount of 30 mg per 1 kg of the emulsion respectively in the same silver bromochloride emulsion as in the above ortho-emulsion and dispersing 2-[α-(2,5-di-t-amylphenoxy)butylamido]-4,6-dichloro-5-methylphenol as a cyan coupler in the emulsion so as to contain 0.1 mole of the said compound per 1 mole of silver halide. The thus prepared emulsions were coated on the said multilayer parts and further a gelatine protecting layer was provided. Four kinds of the colour printing photographic materials, that is, Samples 15–16, and Control Samples (7)–(8) were thus obtained.

These two Samples and two Control Samples were exposed by the same procedure as in Example 1 and developed at 38° C for 3 minutes and 15 seconds with a colour developer of the following composition:

| | |
|---|---|
| Anhydrous sodium hydrogen carbonate | 29.5 g |
| Potassium sulfite (two hydrate) | 2.0 g |
| Potassium bromide | 1.3 g |
| Sodium nitrilotriacetate (one hydrate) | 2.0 g |
| Potassium hydroxide | 0.4 g |
| Hydroxylamine sulfate | 2.0 g |
| 4-Amino-3-methyl-N-methyl(β-hydroxyethyl)-aniline sulfate | 5.0 g |
| Water to make | 1 l |

Subsequently, the developed photographic films were subjected to ordinary bleaching, fixing, washing with water and drying treatments. The sensitivity and fog of the red-sensitive emulsion layers forming cyan dye images were measured and the results are shown in Table III.

Table III

| Sample No. | | Added sensitizing dye | | Sensitivity | Fog |
|---|---|---|---|---|---|
| Sample | 15 | Exemplified compound | (1) | 140 | 0.05 |
| | 16 | " | (2) | 165 | 0.06 |
| Control Sample | 7 | Control compound | (A) | 100 | 0.11 |
| | 8 | " | (B) | 120 | 0.10 |

In Table III, the sensitivity was expressed in a relative value as 100 of that of the Control Sample (7).

As is clear from Table III, it is understood that the Samples using the sensitizing dyes according to this invention provide high-sensitive photographic material causing little fog even in the coexistence of a colour coupler.

What is claimed is:

1. A light sensitive silver halide photographic material containing at least one sensitizing dye selected from the group consisting of:

(1) 1'-Carbamoylmethyl-3-ethyl-6,7-benzothia-4'-carbocyanine chloride, (2) 1'-Carbamoylmethyl-3-ethyl-4,5-benzothia-4'-carbocyanine iodide,
(3) 1'-Carbamoylmethyl-3-ethyl-6-methoxy-4,5-benzothia-4'-carbocyanine chloride,
(4) 1'-Carbamoylmethyl-3-ethyl-6'-methyl-4,5-benzothia-4'-carbocyanine chloride,
(5) 1'-Carbamoylmethyl-3-ethyl-6'-methoxy-4,5-benzothia-4'-carbocyanine chloride,
(6) 1'-Diethylcarbamoylmethyl-3-ethyl-4,5-benzothia-4'-cyanine iodide,
(7) Anhydro-1'-carbamoylmethyl-3-(3-sulfopropyl)-5,6-benzothia-4'-carbocyanine hydroxide,
(8) 1'-Carbamoylmethyl-3-ethyl-6,7-benzoselena-4'-carbocyanine chloride, and
(9) 1'-Carbamoylmethyl-3-ethyl-4,5-benzoxa-4'-carbocyanine iodide.

2. The photographic materials of claim 1, wherein the compound is 1'-carbamoylmethyl-3-ethyl-6,7-benzothia-4'-carbocyanine chloride.

3. The photographic materials of claim 1, wherein the compound is 1'-carbamoylmethyl-3-ethyl-4,5-benzothia-4'-carbocyanine iodide.

4. The photographic materials of claim 1, wherein the compound is 1'-carbamoylmethyl-3-ethyl-6-methoxy-4,5-benzothia-4'-carbocyanine chloride.

5. The photographic materials of claim 1, wherein the compound is 1'-carbamoylmethyl-3-ethyl-6'-methyl-4,5-benzothia-4'-carbocyanine chloride.

6. The photographic materials of claim 1, wherein the compound is 1'-carbamoylmethyl-3-ethyl-6'-methoxy-4,5-benzothia-4'-carbocyanine chloride.

7. The photographic materials of claim 1, wherein the compound is 1'-diethylcarbamoylmethyl-3-ethyl-4,5-benzothia-4'-cyanine iodide.

8. The photographic materials of claim 1, wherein the compound is anhydro-1'-carbamoylmethyl-3-(3-sulfopropyl)-5,6-benzothia-4'-carbocyanine hydroxide.

9. The photographic materials of claim 1, wherein the compound is 1'-carbamoylmethyl-3-ethyl-6,7-benzoselena-4'-carbocyanine iodide.

10. The photographic materials of claim 1, wherein the compound is 1'-carbamoylmethyl-3-ethyl-4,5-benzoxa-4'-carbocyanine iodide.

* * * * *